US009251695B2

(12) United States Patent
McNutt et al.

(10) Patent No.: US 9,251,695 B2
(45) Date of Patent: Feb. 2, 2016

(54) SYSTEM AND METHODS FOR PROVIDING NOTIFICATION IN THE EVENT OF A SECURITY CRISIS

(71) Applicants: John McNutt, Elgin, IL (US); Ken Volkening, Hampshire, IL (US); John Shales, Elgin, IL (US); Todd Stirn, Aurora, IL (US)

(72) Inventors: John McNutt, Elgin, IL (US); Ken Volkening, Hampshire, IL (US); John Shales, Elgin, IL (US); Todd Stirn, Aurora, IL (US)

(73) Assignee: BluePoint Alert Solutions, LLC, Elgin, IL (US)

( * ) Notice: Subject to any disclaimer, the term of this patent is extended or adjusted under 35 U.S.C. 154(b) by 0 days.

(21) Appl. No.: 14/331,875

(22) Filed: Jul. 15, 2014

(65) Prior Publication Data

US 2015/0015381 A1 Jan. 15, 2015

Related U.S. Application Data

(60) Provisional application No. 61/846,359, filed on Jul. 15, 2013.

(51) Int. Cl.
*G08B 25/00* (2006.01)
*G08B 25/12* (2006.01)

(52) U.S. Cl.
CPC ..... *G08B 25/12* (2013.01)

(58) Field of Classification Search
CPC ..... G08B 25/12; G08B 25/10; G08B 13/1966
USPC ..... 340/287, 540, 541, 506, 521, 5.61, 340/539.1, 539.13, 539.22; 438/143, 152, 438/153, 154
See application file for complete search history.

(56) References Cited

U.S. PATENT DOCUMENTS

| | | | | |
|---|---|---|---|---|
| 6,052,052 | A * | 4/2000 | Delmonaco | 340/539.11 |
| 6,658,091 | B1 * | 12/2003 | Naidoo et al. | 379/37 |
| 7,113,090 | B1 * | 9/2006 | Saylor et al. | 340/539.18 |
| 8,310,365 | B2 * | 11/2012 | Siegler et al. | 340/541 |
| 2014/0266678 | A1 * | 9/2014 | Shapiro et al. | 340/514 |

* cited by examiner

*Primary Examiner* — Tai T Nguyen
(74) *Attorney, Agent, or Firm* — Jeffrey A. Pine; Dykema Gossett PLLC

(57) ABSTRACT

The present invention provides a system and methods for notifying first responders of a security crisis or threat. The alarm system can be scaled to allow the alarm system to be used effectively in facilities of differing sizes and layouts. The system is also flexible, enabling the system to integrate with currently existing systems or to operate with new devices.

18 Claims, 3 Drawing Sheets

SYSTEM AND METHODS FOR PROVIDING NOTIFICATION IN THE EVENT OF A SECURITY CRISIS

FIELD OF THE INVENTION

The instant disclosure relates to a building notification system for providing notification in the event of a security crisis. More specifically, the instant disclosure relates to a notification system and methods for providing fast and reliable notification of, and information relating to, a security crisis to first responders, individuals within the vicinity of the crisis and others, using a point-identifiable signal emanating from the source of the crisis.

BACKGROUND OF THE INVENTION

There are a number of events that can occur in public and private buildings that rise to the level of a crisis for which first responders, such as fire fighters and police officers, must be called on for assistance. These events can include fire, armed intruders, burglary, acts of terrorism, among others. Many times, the damage and harm from these events can be minimized or eliminated if individuals near the location of the crisis, first responders and others are notified quickly, provided related information and allowed to respond in accordance with their abilities. For example, individuals near the crisis may be allowed to exit the arena, a school for example, to avoid harm, while first responders may be notified of the existence of the crisis earlier and be able to take quick action to minimize the damage.

An example of a notification system is a building fire alarm notification system, which is capable of notifying first responders or fire fighters and building occupants of the existence of a fire. These systems are well known and have been employed for many years at public and private locations, such as schools, libraries, hospitals, shopping malls, etc. In general, fire alarm notification systems are utilized in large public or commercial buildings in which a significant number of individuals or occupants may be located at any given time. The typical fire alarm notification system provides for some or all of the following functions: detecting a fire (or providing individuals with the chance to notify others of the existence of a fire), notifying nearby occupants of the presence of a fire, notifying the fire department and other emergency personnel, and in some cases, operating certain fire safety functions, such as closing fire retardant doors, setting off the sprinkler system, etc.

Fire alarm notification systems often incorporate detection measures or devices to detect a fire, such as fire and smoke detectors. Additionally, manual fire alarm pull boxes may be placed at strategic locations around a building so that individuals can use the manual boxes, which may commence the notification process earlier than if the notification process was started using the automated fire and smoke detectors. The fire alarm notification systems are usually wired throughout a building so that whether a manual pull box is engaged, or a smoke detector detects smoke and sets off an alarm, occupants are quickly notified, fire safety functions can be initiated and the fire department can be automatically notified, usually through an approved central station dispatch or monitor.

To warn building occupants, for example, a siren or sound loud enough to indicate the presence of a fire hazard can be sounded along with instructions to direct emergency evacuation. Visual indicators of the fire emergency may be employed in combination with the sound producing fire warning devices. The most common devices employed include horns, bells, sirens, stroboscopic lights, and speakers.

Although private locations, such as homes and businesses incorporate fire alarm notification systems and security alarms, which likewise, attempt to prevent a security crisis, such as burglaries or other illegal activities; public locations need a security crisis notification system for notifying individuals located near the vicinity of the security crisis, especially for acts of terrorism or armed intruders, such as those that have occurred over the years at public schools and other public locations. A first responder security notification system used primarily for acts of terrorism would provide individuals near the security crisis an increased ability to quickly notify first responders of the crisis, while also quickly notifying those near the vicinity of the crisis. Over time, and because of the similarities to existing notification systems, building occupants and others would understand the function of the system and be able to utilize the notification devices as necessary to notify first responders and others of the crisis.

Further, since the response of individuals in the area is different from a fire crisis, a police emergency system is needed. As such, there currently exists a need for a first responder crisis notification system and methods that minimize the time from the inception of the crisis until providing of notification to the first responders and others, allowing faster reaction time and the reduction or elimination of damage and harm to those in the vicinity of the crisis. Quick notification and the transmission of information to the first responders and emergency authorities, along with notification and instructions to those in the vicinity of the crisis is vital for reducing injury and death during a security crisis event.

SUMMARY OF THE INVENTION

One aspect of the present disclosure is a system and methods for providing notification to building occupants or other individuals near a security crisis, while also notifying first responders or those that provide emergency services during such a security crisis. Along with notification to the first responders, information can also be provided, based on the system devices that can assist in the identification of the location in a building or facility, where the crisis has occurred, or to where the crisis has moved in real time. A point-identifiable security crisis alarm, which can inform first responders, such as police officers or SWAT officers where the crisis started, can also provide additional information, such as video and audio from cameras and microphones in the arena, to assist in responding to the security crisis or threat.

The crisis notification system is scalable, and the scalability of the notification system or crisis security alarm system allows the system to be used effectively in different size facilities regardless of the design or layout. The notification system is also flexible, using pendants or fixed pulls or a combination of each, enabling the alarm system to be integrated with currently existing systems, such as fire alarm systems, or to be configured to operate with new devices, such as alarm pulls and transmitters, as described herein. Further, video cameras, microphones and other information gathering devices located in the facility can be incorporated into the crisis notification system along with particular building information, such as floor plans, utilities and power layouts and other information as necessary to provide real time crisis information before and during the crisis. This information can be provided to the first responders at a central dispatch, at mobile locations, such as squad cars and emergency vehicles and even to individual mobile devices, such as cell phones, laptops and tablets, for example.

By using existing alarm systems, such as fire alarm notification systems, public address (PA) systems, etc., the present notification system does not need to utilize its own communication backbone or standalone security crisis alarm transmission devices. However, a separate alarm system can be implemented alongside an existing fire alarm system or in a location in which no fire alarm system exists. The crisis notification system can utilize point-identifiable security crisis signals indicating a location in the facility where the crisis began or has moved to, can be sent to first responders, along with necessary information for a quicker or immediate response to the security threat. The system can employ innovative notification devices, such as intelligent alarm pulls, pendants and switches that may be integrated with other notification devices and systems as described herein.

Other objects and advantages of the present disclosure will become apparent to one having ordinary skill in the art after reading the specification in light of the drawing figures, however, the spirit and scope of the present disclosure should not be limited to the description of the embodiments contained herein.

BRIEF DESCRIPTION OF THE DRAWINGS

The preferred embodiments of the invention will be described in conjunction with the appended drawings, which illustrate and do not limit the scope of the invention, where like designations denote like elements, and in which.

DETAILED DESCRIPTION OF THE INVENTION

The present invention provides a system and methods for providing notification to first responders or emergency service personnel of a security crisis or potential security crisis. In doing so, point-identifiable security crisis alarm signals, from stationary pulls or buttons, or as wearable pendants, capable of indicating a specific location in a facility, are provided to the first responders for their immediate response to the security threat. Further, depending on the specifications of the crisis notification system, along with the location of the crisis (or at least where the crisis alarm was first reported), information about the crisis can be transmitted to the first responders. The crisis information may include audio or video of the crisis arena, along with specific information about the building layout and utilities, for example.

As described herein, the scalability of the crisis notification system allows the system to be used effectively in facilities of different sizes and layouts. The system is also flexible, enabling the alarm system to be configured to integrate with existing fire or other alarm systems or to operate independently as a new crisis notification or alarm system.

Although the crisis notification system described herein can be incorporated into existing alarm communication backbones, such as existing fire alarm systems, or standalone security crisis alarm transmission devices, the preferred embodiment is an independent, stand-alone system, made up of stationary pulls, and buttons, wearable pendants, strobe devices, among other devices as described herein. And, although the notification system can be incorporated into existing fire alarm systems, for example, the signal that is created in the present security crisis notification system is distinct and separate from any fire alarm signal that may propagate on the same communications bus. The system may also employ innovative notification devices for detecting a security crisis, or for taking preventative action during a security crisis, and these devices can be integrated into other notification devices and systems.

Figure 1:
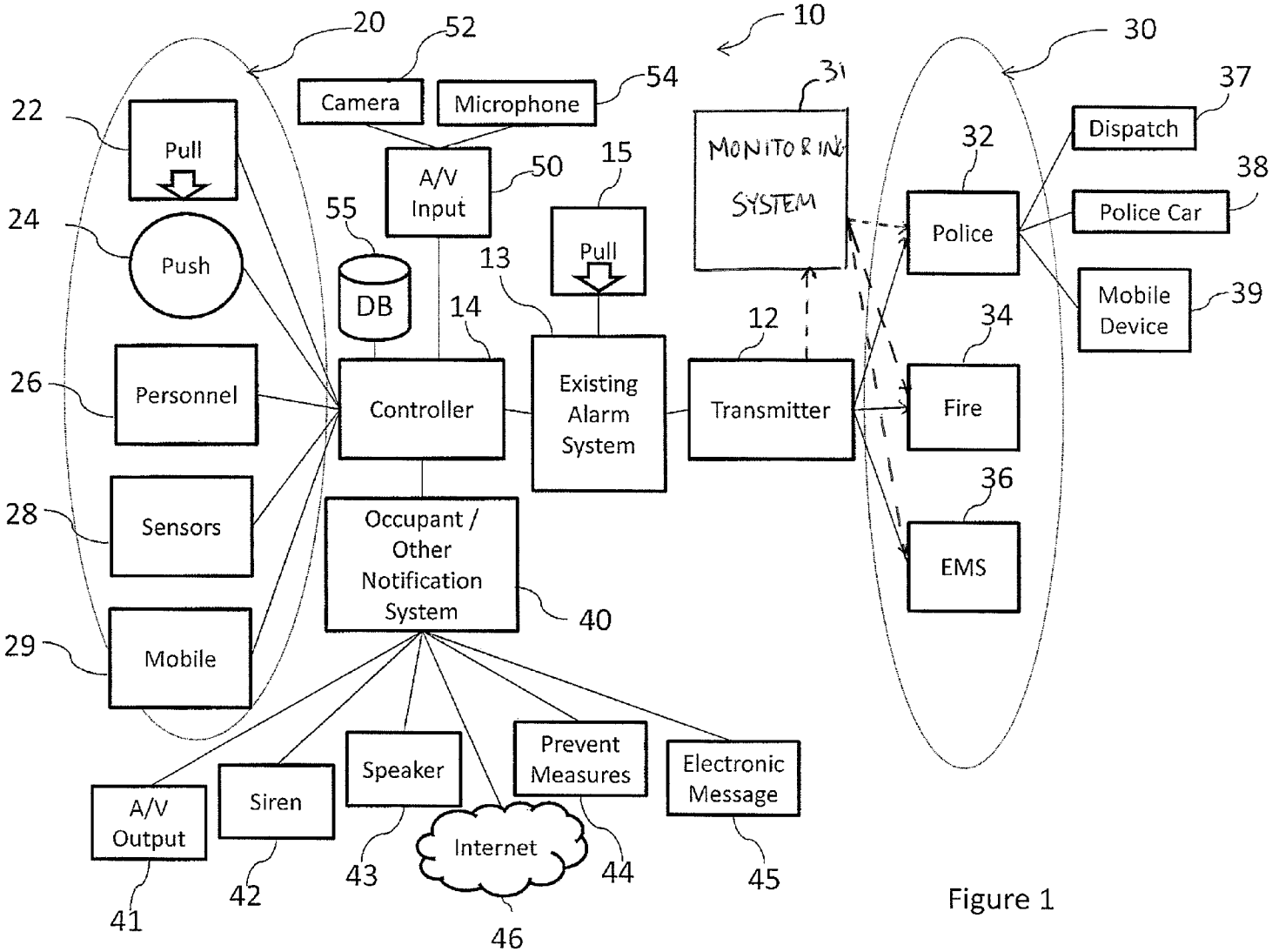
FIG. 1 is a security crisis alarm and notification system in accordance with the present disclosure.

FIG. 1 shows an exemplary notification alarm system or a security crisis alarm system 10. The system 10 comprises a transmitter 12, an optional existing alarm system 13, a controller 14, and a plurality of alarm actuator devices 20 that can be activated to inform first responders and/or individuals in the vicinity and others of a security crisis.

Exemplary embodiments of alarm actuators 20 include pull down actuators 22 (similar to existing fire alarm pulls), push button actuators 24, and personnel actuators or pendants 26 that can be worn by an individual and depressed to send a wireless signal to the notification system 10 if a security crisis occurs. These devices can be located at specific locations throughout a facility based on a variety of factors. Exemplary pulls or pull down actuator 22 placement factors include traffic pattern, building use, occupant age, floor levels, access patterns, egress patterns, and administrative layouts. The pull down actuators 22 can be wired to the system 10 or in the preferred embodiment are wireless transmitters. The system also may include one or more repeaters to ensure that system signals reach all intended locations.

Further, the personnel actuators or pendants 26 and/or mobile actuators 29 may have GPS functionality or features so that a precise location or approximate location can be determined when the personnel actuator 26 is depressed, or even afterwards to locate the personnel actuator 26. The location of the device can also be determined through triangulation as understood by those having ordinary skill in the art.

Additional actuators 20 can include sensors 28, such as door and window detectors for detecting an unwanted breach of a door or window, audible detectors for detecting sounds at certain decibel levels such as gunshots, broken windows, etc., and mobile actuators 29 that can be used in a mobile environment such as a school bus. Once a sound that resembles a gunshot is detected, the location can be determined using different methods, including triangulation methods, etc. As described herein, each of these actuators 20 can be equipped to provide the location of the actuator at the time it is actuated.

In a security crisis event, the controller 14 determines the location of the activation (usually where the security crisis is occurring) and utilizes the transmitter 12 to send a notification of the security crisis directly and immediately to the first responders 30, such as the police force 32, the fire department 34, or EMS 36. Of course, additional responders can receive the notification, such as FBI or SWAT, etc.

Further, a medical alert system can be added to the crisis alert system, or piggy-backed onto the system, such that, to the extent the area is safe, medical responders can be notified and have a chance to respond as quickly as possible. Once the crisis notification system has been installed, the addition of a medical alert system is simple and straightforward, and may merely include an additional pull down, possibly in another color. For example, if the fire alarm pulls are red, the crisis alert pulls are blue, a medical alert pull may be yellow.

By notifying the police force 32, the notification can be sent to a central dispatch 37, to specific squad cars 38 or to mobile devices 39, such as mobile phones, laptop computers, and computer tablets. This method provides the quickest form of notification to those first responders that need to respond to the security crisis. Further, as described herein, along with the notification, which notifies the first responder of the security crisis and where it is occurring, additional information, such as audio and video signals of the arena, can be transmitted to the first responders at the squad car 38 or through mobile devices 39. Further, to the extent that the first responders do not have full-time access to the school or area, a link on a website can be incorporated to allow the first responders to access the school video or audio at that time.

As described above, the controller 14 polls the alarm actuation devices 20, such that when an alarm actuator device 20 is activated, the controller 14 receives a signal to activate the alarm system 10. The controller 14 can determine the originating alarm actuator device 20 and its location. The controller 14 then activates an occupant notification system 40, possibly through the existing or new PA system, and may also commence building safety measures. Besides notifying building occupants, the occupant notification system 40 may provide notifications to other individuals that have a need to know about the security crisis, such as school administration, principles of nearby schools, nearby offices and residences and parents of children at the school. The Notification system 10 can be configured to provide different notifications to different recipients depending on the security crisis.

Exemplary embodiments of building occupant (and other) notification devices 40 include an audio/video output 41, sirens 42 such as bells, whistles, stroboscopic lights, and speakers 43, such as those in the existing PA system or others. In the preferred embodiment, all of the devices 40 can be implemented through a wireless system, except the strobes, which may or may not be wired together. Exemplary embodiments also include building safety measures 44 including solenoids that close and lock certain doors or access ways. Additional embodiments include the transmission of electronic messages 45 through email, text, SMS or other predetermined techniques, and transmission of messages to social networks through the Internet 46, among others.

The controller 14 determines the point-identifiable location of the alarm actuator device 20 that was activated and then formats the point-identifiable signal notification according to the transmitter 12 communication protocol. Along with the location information, the controller 14 may be capable of receiving additional information, such as video and sound, from one or more A/V input devices 50, which receive information at the security crisis location from cameras 52 and/or microphones 54. This additional information can be combined with the signal being sent to the first responders or it can be transmitted separately.

The transmitter 12 receives the point-identifiable signal notification and any additional information from the A/V input devices 50, formatted as necessary by the controller 14 and according to the transmitter 12 communication protocol. The controller 14 may also have a database 55 containing information about the particular building, such as floor layout, utilities, power grid, etc. and that information may also be transmitted to the first responders to assist in responding to the security crisis.

Upon receiving the signal, the transmitter 12 immediately sends the point-identifiable signal notification and any additional information as necessary formatted according to the transmitter 12 communication protocol to the first responders 30 or to a monitoring organization or system 31. If the transmitter 12 transmits to the monitoring organization 31, then the monitoring organization 31 transmits the notification and/or information to the first responders 30. The first responders 30 receive the notification and additional information, at the locations and using the devices described above, from the crisis notification system 10 and then can respond to the security crisis with this additional knowledge. Authorized personnel can reset the alarm system 10 after elimination of the security threat.

As described herein, The crisis notification system 10 can be configured to work with an existing building fire alarm system 13 that use similar pull devices 15, or the crisis notification system 10 can be a standalone system as in the preferred embodiment. Also, as described herein, each of the components of the crisis notification system can be wired together, or as in the preferred embodiment, can be a part of a wireless system, using repeaters where necessary.

The plurality of alarm actuator devices 20 can be electrically connected to the controller 14. Electrical connections include all known electrical communication methods including, but not limited to, hardwired (possibly through an existing alarm system) and wireless communication technologies, such as those that use radio frequencies in the 900 MHz, 2.5 or 5 GHz range, Wi-Fi, Bluetooth, Zigbee, etc., all of which are known to one of ordinary skill in the art.

As described above, the pull down actuator 22 is actuated by pulling down on a handle, similar to the red fire alarms in many school buildings, while the push button actuator 24 is activated by pushing down on the push button. These devices can be located at specific locations throughout a facility based on a variety of factors. Exemplary push button actuator 24 placement factors include traffic pattern, building use, occupant age, floor levels, access patterns, egress patterns, and administrative layouts. Often, these push buttons 24 will be located in out of the way places, such as under desks or tables, where depressing the button would not be noticed in a crisis event.

The personnel actuator or pendants 26 includes a variety of devices carried on or by an individual. An exemplary personnel actuator 26 is an electronic pendant system that is connected to the controller 14 via a wireless connection, as described herein. The personnel actuator 26 can be electrically connected to the controller 14 in any of the known electrical communication methods. In the exemplary system, personnel actuators 26 are placed in the possession of strategic faculty or staff members. Also, the personnel actuators 26, since they are mobile, can be depressed a number of times during the security crisis, which can provide additional information as to the location of the individual wearing the personnel actuator 26.

The building occupant notification system 40, such as the existing or an added PA system, which is used to warn building occupants and others of the security crisis or threat through the use of notification devices 41-45, is flexible and can be integrated with existing mass notification devices. An exemplary mass notification system 40 may send out text or other communication messages 45 to every listed occupant of the building and their emergency contacts upon activation of a security crisis notification system 10. The exemplary system may also broadcast notification through other communication methodologies and mediums such as the Internet 46, or radio or cable.

Figure 2:
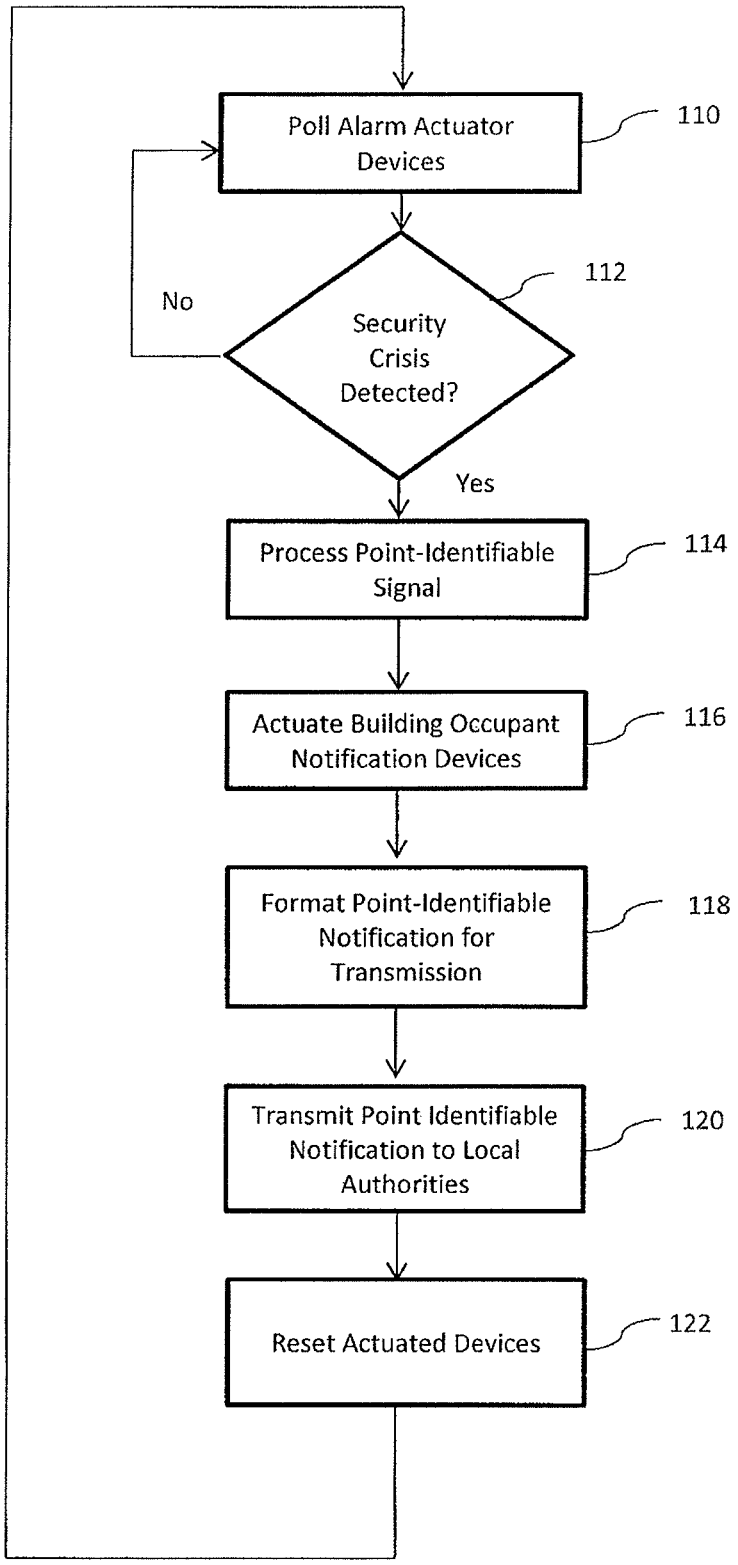
FIG. 2 is a flow chart that illustrates the security crisis alarm activation and notification in accordance with the present disclosure.
Figure 3:
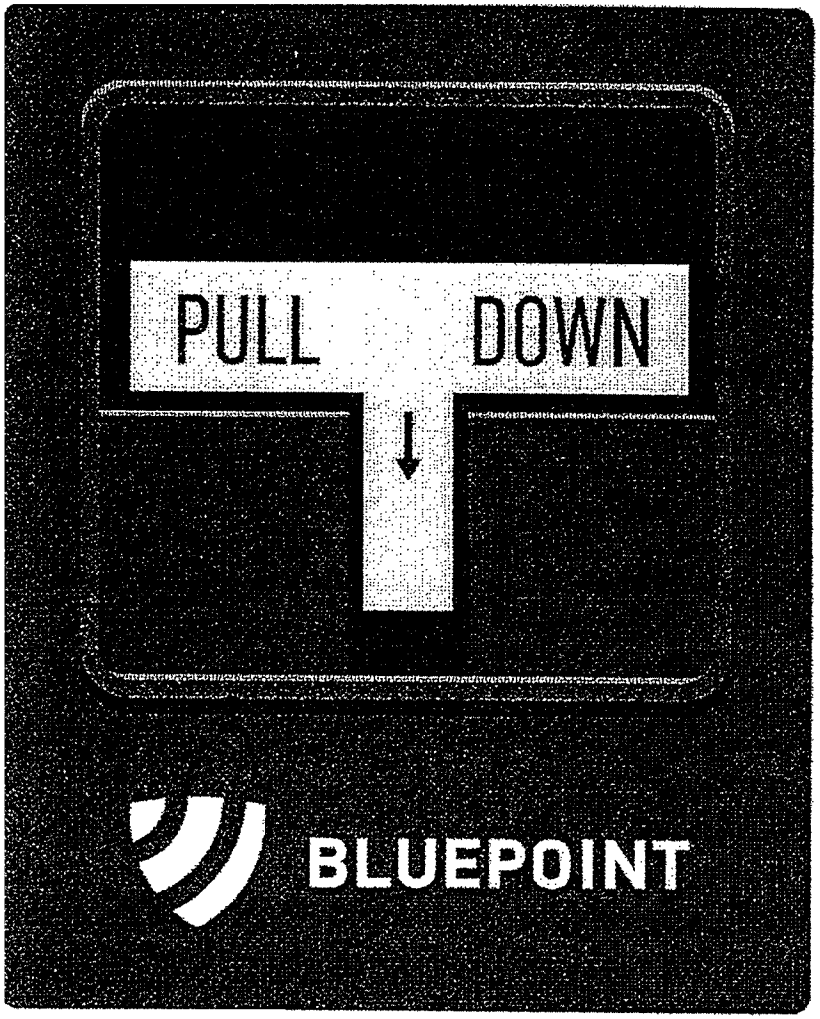
FIG. 3 is a drawing of a pull-down security crisis alarm actuation device in accordance with the present disclosure.

FIG. 2 shows an exemplary flow chart detailing the steps that can be performed in accordance with the preferred embodiment of the security crisis notification system 10.

As described in detailed herein, the controller 14 polls the alarm actuation devices 20 at step 110. When an alarm actuator device 20, such as an alarm pull 22, a push button 24, a pendant 26, or a sensor 28, is activated, the controller 14 detects a security event or crisis at step 112. The controller 14 may then processes the point-identifiable notification signal at step 114 to determine the location of the actuator 20 that was activated. The controller 14 then signals the occupant and other notification system 40 to actuate the building occupant notification devices 41-46 at step 116. The controller 14 may incorporate the point-identifiable information into the occupant notification strategy to provide specific instructions and safety information to building occupants and others depending on the activated actuator device 20 location within the facility.

In the preferred embodiment, each alarm actuator device 20 of the crisis notification system 10 is point-identifiable, so that the particular device location can be determined along with any other necessary information, upon activation. A monitoring system 31 can be located in between the crisis notification system 10 and the first responders 30, such that when an activation occurs, the monitoring system 31 is first made aware of the crisis and can then relay the notification, the device location, and any other information as needed, to the first responders 30 in accordance with previously determined police or responder protocols.

As described above, the controller 14 may also include additional information from the A/V input devices 50 and from the database 55 pertaining to the building information. The transmitter 12 can then receive the formatted signal and send the formatted point-identifiable notification signal and any additional information to the first responders 30 through a dispatch 37 (if configured as such), to the squad car 38 or to mobile devices 39 or in other ways at step 120. The system 10 may continue to update the additional information as necessary, including audio and visual information pertaining to the crisis. The dispatch or monitor can then dispatch first responders to address the crisis or security threat. The alarm system 10 is reset at step 122.

Battery backups can be incorporated into the point-identifiable actuation devices 20 to ensure that the devices 20 are always powered. The system 10 can supervise or check in with each device 20 to make sure the device 20 is powered and in working order. This supervision process can occur periodically, for example every few minutes, to supervise the system 10 for proper function, low battery, missing pendants, etc. The system 10 can keep track of the supervision function in a database, and accordingly, the system 10 can generate reports on the system devices or the system as a whole.

Although a number of embodiments of this invention have been described above with a certain degree of particularity, those skilled in the art could make numerous alterations to the disclosed embodiments without departing from the spirit or scope of this invention. For example, all joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

The invention claimed is:

1. A security threat alarm system for notifying a monitoring organization of a security threat comprising:

a plurality of alarm actuation devices, said plurality of alarm actuation devices being located in a same building, and comprising at least one manual pull down device, wherein at least one of said plurality of alarm actuation devices is actuated upon a security threat and said at least one manual pull down device must be manually activated, and each of said plurality of alarm actuation devices provides a location signal indicating the location in the building of the one of the plurality of alarm actuation devices that has been actuated;

at least one indicator, said at least one indicator being located in the same building, wherein when one of said plurality of alarm actuation devices is actuated, said indicator notifies at least one occupant of said building that one of said plurality of alarm actuation devices has been actuated;

a controller, said controller coupled to said plurality of alarm actuation devices and coupled to said at least one indicator, said controller receiving said location signal from one or more of said plurality of alarm actuation devices upon actuation and determining the location of the one or more of the plurality of alarm actuation devices that has been actuated, said controller controlling said at least on indicator to notify said at least one occupant of said building that one of said plurality of alarm actuation devices has been actuated;

a transmitter, said transmitter coupled to said controller, said transmitter transmitting said location signal received from said controller upon actuation of said one or more of said plurality of alarm actuation devices;

wherein upon actuation of said one or more of said plurality of alarm actuation devices, a location signal is sent to said controller, said controller determines the location in the building of the one or more of said plurality of alarm actuation devices that has been actuated, and said controller instructs the transmitter to transmit a notification of the location of the one or more of said plurality of alarm actuation devices that has been actuated to said monitoring organization, thereby informing said monitoring organization of the location in the building of the alarm actuation device that has been actuated.

2. The security threat alarm system of claim 1, further comprising wherein said monitoring organization forwards said notification of the location of the one or more of said plurality of alarm actuation devices that has been actuated to at least one first responder.

3. The security threat alarm system of claim 1, wherein said plurality of alarm actuation devices comprises at least one manual push button device.

4. The security threat alarm system of claim 1, wherein said plurality of alarm actuation devices comprises at least one manual pendant device.

5. The security threat alarm system of claim 1, wherein said at least one indicator notifies at least one occupant of said building that one of said plurality of alarm actuation devices has been actuated through a pre-recorded message.

6. The security threat alarm system of claim 1, wherein said at least one indicator notifies at least one occupant of said building that one of said plurality of alarm actuation devices has been actuated through a strobe light.

7. The security threat alarm system of claim 1, wherein said at least one indicator notifies at least one occupant of said building that one of said plurality of alarm actuation devices has been actuated through a horn.

8. The security threat alarm system of claim 1, wherein said transmitter is configured to transmit to said monitoring organization, a signal pertaining to an area near the one or more of said plurality of alarm actuation devices that has been actuated.

9. The security threat alarm system of claim 8, wherein said signal includes audio and video information and said audio and video information is available to at least one first responder from said monitoring organization when one of said plurality of alarm actuation devices has been actuated.

10. A method for notifying a monitoring organization of a security threat, using a security threat alarm system comprising in the same building a plurality of alarm actuation devices, comprising at least one manual pull down device, providing a location signal and upon being actuated, a controller, a transmitter, and at least one indicator for notifying at least one occupant of said building that one of said plurality of alarm actuation devices has been actuated, comprising the steps of:

a) locating said plurality of alarm actuation devices, comprising at least one manual pull down device, in the same building, wherein said at least one pull down device must be manually actuated;

b) monitoring said plurality of alarm actuation devices to determine if at least one of said plurality of alarm actuation devices is actuated;

c) upon actuation, receiving a location signal to determine where in the building said one or more of the plurality of alarm actuation devices has been actuated;

d) transmitting a notification of location to a monitoring organization: and e) notifying at least one occupant of said building that one of said plurality of alarm actuation devices has been actuated.

11. The method of transmitting a notification of location to a monitoring organization of a security threat of claim 10, further comprising the step of forwarding said notification of location to at least one first responder.

12. The method of transmitting a notification of location to a monitoring organization of a security threat of claim 10, wherein said plurality of alarm actuation devices comprises at least one manual push button device.

13. The method of transmitting a notification of location to a monitoring organization of a security threat of claim 10, wherein said plurality of alarm actuation devices comprises a manual pendant device.

14. The method of transmitting a notification of location to a monitoring organization of a security threat of claim 10, wherein the said at least one indicator notifies at least one occupant of said building that one of said plurality of alarm actuation devices has been actuated through a pre-recorded message.

15. The method of transmitting a notification of location to a monitoring organization of a security threat of claim 10, wherein the said at least one indicator notifies at least one occupant of said building that one of said plurality of alarm actuation devices has been actuated through a strobe light.

16. The method of transmitting a notification of location to a monitoring organization of a security threat of claim 10, wherein the said at least one indicator notifies at least one occupant of said building that one of said plurality of alarm actuation devices has been actuated through a horn.

17. The method of transmitting a notification of location to a monitoring organization of a security threat of claim 10, wherein said transmitter is configured to transmit to a monitoring organization, a signal pertaining to the area near the one or more of said plurality of alarm actuation devices that has been actuated.

18. The method of transmitting a notification of location to a monitoring organization of a security threat of claim 17, wherein said signal includes audio and video information and said audio and video information is available to at least one first responder from said monitoring organization when one of said plurality of alarm actuation devices has been actuated.

* * * * *